US006591580B1

(12) United States Patent
Tharpe, Jr.

(10) Patent No.: US 6,591,580 B1
(45) **Date of Patent: *Jul. 15, 2003**

(54) SHOCK AND MOISTURE ABSORBING PAD AND APPARATUS AND METHODS FOR FORMING AND USING SAME

(76) Inventor: John M. Tharpe, Jr., 1610 Louise Ave., Panama City, FL (US) 32401

( * ) Notice: Subject to any disclaimer, the term of this patent is extended or adjusted under 35 U.S.C. 154(b) by 0 days.

This patent is subject to a terminal disclaimer.

(21) Appl. No.: 09/443,833

(22) Filed: Nov. 19, 1999

Related U.S. Application Data

(63) Continuation-in-part of application No. 09/201,950, filed on Dec. 1, 1998, now Pat. No. 6,311,458.

(51) Int. Cl.[7] ..... B65B 9/02
(52) U.S. Cl. ..... 53/139.5; 53/472
(58) Field of Search ..... 53/115, 122, 139.5, 53/450, 472, 550, 553, 521, 524, 526, 528; 493/464, 967

(56) References Cited

U.S. PATENT DOCUMENTS

| | | | | | |
|---|---|---|---|---|---|
| 1,573,599 | A | * | 2/1926 | Elliott | 53/24 |
| 2,119,982 | A | * | 6/1938 | Blosser et al. | 53/521 X |
| 2,121,454 | A | * | 6/1938 | Teall | 53/521 X |
| 2,610,134 | A | * | 9/1952 | Hoblick | 53/24 |
| 2,907,447 | A | * | 10/1959 | Offutt et al. | 53/24 |
| 3,020,687 | A | * | 2/1962 | Joa | 53/24 |
| 3,201,295 | A | * | 8/1965 | De Woskin | 53/24 |
| 3,206,345 | A | * | 9/1965 | Stickel | 53/24 |
| 3,526,078 | A | * | 9/1970 | Dye | 53/24 |
| 3,606,726 | A | * | 9/1971 | Spertus et al. | 53/24 |
| 4,089,149 | A | * | 5/1978 | Evans | 53/24 |
| 6,311,458 | B2 | * | 11/2001 | Tharpe, Jr. | 53/115 |

OTHER PUBLICATIONS

Quotation #Q3358–B, A.P.W., Inc., Jan. 28, 1998.

* cited by examiner

*Primary Examiner*—Rinaldi I. Rada
*Assistant Examiner*—John Paradiso
(74) *Attorney, Agent, or Firm*—Allen, Dyer, Doppelt, Milbrath & Gilchrist, P.A.

(57) ABSTRACT

An apparatus for producing a plurality of shock and moisture absorbing pads is provided. The apparatus preferably includes a waste material grinder positioned to grind the relatively large particle waste material into relatively much smaller particles, a ground waste core material feeder positioned to feed ground waste core material downstream, a core pad former positioned to form the core material into a plurality of individual core pads, a core pad encaser positioned to encase the plurality of individual core pads with a selected sheet of material to thereby form a sheet of a plurality of shock and moisture absorbing pads, and a pad separator positioned to separate the sheet into a plurality of individual shock and moisture absorbing pads. A shock and moisture absorbing pad is also provided and preferably includes a core pad formed from a particulate material, an elongate lower sheet underlying the core pad, an elongate upper sheet overlying the core pad, and an adhesive material contacting each of the upper and lower sheets. The particulate material of the pad preferably includes at least one of the following: super absorbency material, fluff, elastic, polymeric material, and glue. Also, the upper and lower sheets of the pad preferably include paper.

12 Claims, 3 Drawing Sheets

FIG. 4.
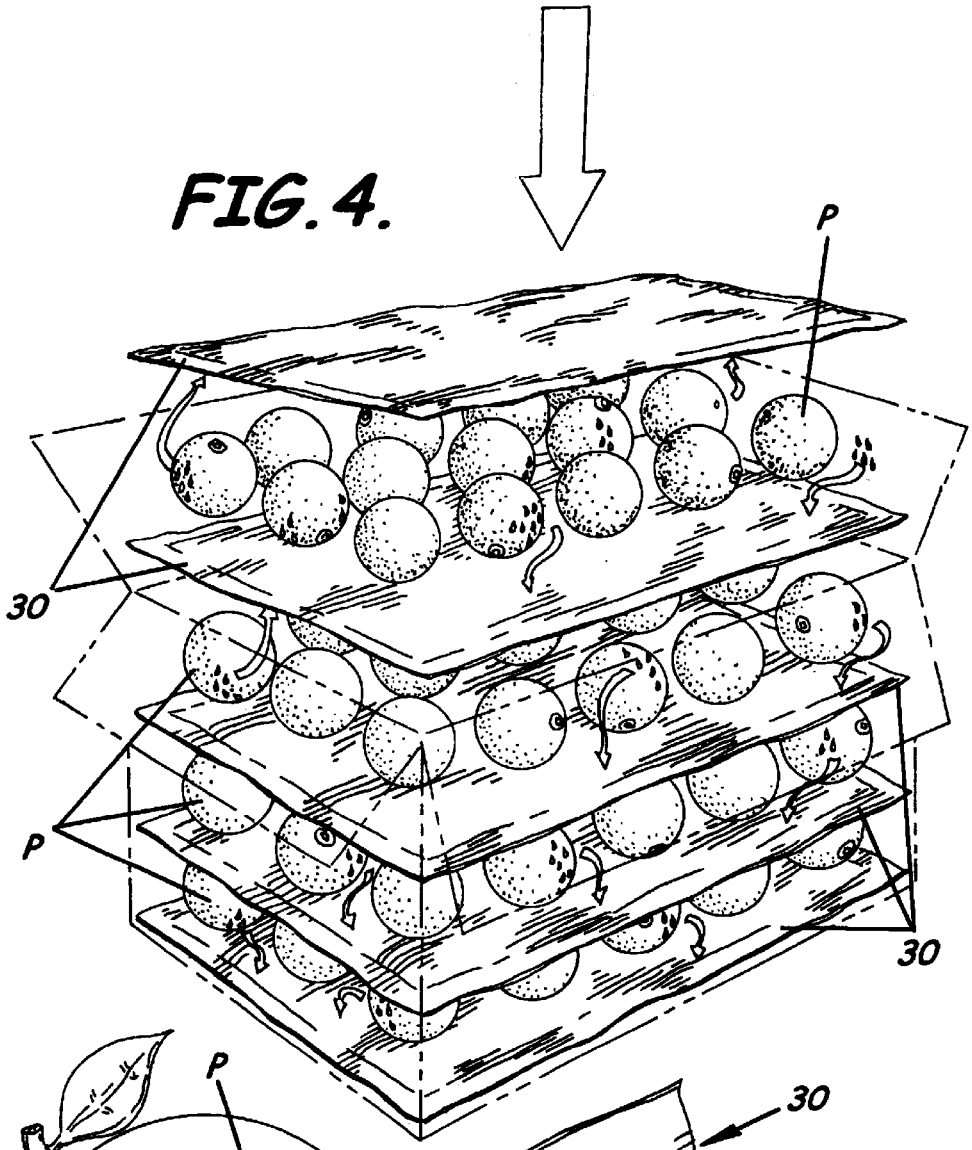
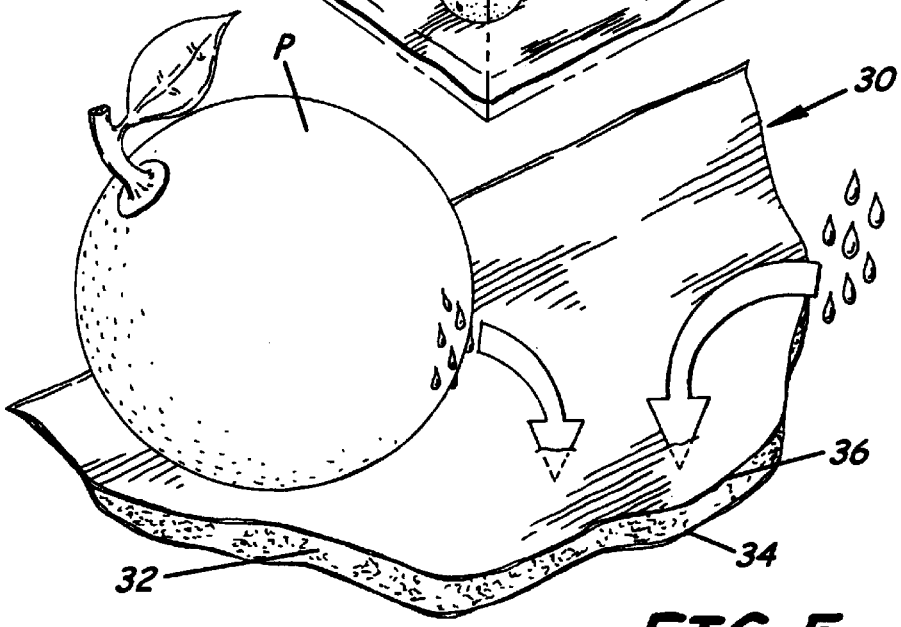
FIG. 5.

SHOCK AND MOISTURE ABSORBING PAD AND APPARATUS AND METHODS FOR FORMING AND USING SAME

CROSS-REFERENCE TO RELATED APPLICATION

This application is a continuation-in-part of U.S. patent application Ser. No. 09/201,950, filed Dec. 1, 1998, now U.S. Pat. No. 6,311,458, and which is hereby incorporated herein by reference in its entirety.

FIELD OF THE INVENTION

The present invention relates to the product packing industry and, more particularly, to the field of packing, handling, and shipping products.

BACKGROUND OF THE INVENTION

In the produce industry, for example, numerous schemes have been developed over the years for packing produce for shipment purposes which greatly reduce damage to or bruising of the produce or other products in the handling and shipping processes. Examples of these products or produce may be apples, pears, peaches, oranges, and grapefruits which can be easily bruised, smashed, or inflicted with other types of damaged by the packing and shipping processes. With such fragile items as fresh produce, the requirements of carefully packing and handling can slow down the production process considerably.

Various shock absorbing packaging techniques have been used for fresh produce such as packing the produce in foam boxes or foam wrap, adding plastic bubble-wrap to a box or package, and adding a large number of foam particles or chunks of foam to a box or package after the produce has been placed in the box. Other attempts to reduce or prevent damage have included foam wrapping or padding for individual pieces of produce as well as boxes, cartons, crates, or other containers of a plurality of pieces of produce. These prior techniques, however, have numerous drawbacks. For example, foam and plastic do not have very good environmentally friendly traits, e.g., often not readily recyclable. Also, some of these techniques can slow down the packaging process. Further, using the chunks of foam, for example, can be messy for both the company packing the produce and for the person or company receiving the produce when the produce is unpacked and can raise environmental concerns.

SUMMARY OF THE INVENTION

In view of the foregoing background, the present invention advantageously provides an apparatus and methods for producing shock and moisture absorbing pads at a relatively high speed for use in readily packing products which can be damaged in the packing and shipping processes. The present invention also advantageously provides an apparatus and method for producing shock and moisture absorbing pads which take use waster or other materials from another manufacturing process to enable the manufacturers to derive benefit from these what otherwise would be waste materials. The present invention yet also advantageously provides an apparatus and methods for producing shock and moisture absorbing pads which allow easy packing of products during a packing process. The present invention additionally provides an apparatus and methods for producing shock and moisture absorbing pads which are relatively inexpensive, are environmentally friendly, and are quite effective in protecting products during shipment. The present invention further provides an apparatus and methods for producing shock and moisture absorbing pads which can utilize existing stock, waste product, or other debris from a packing company, as well as various types of debris, to form core or core material for each pad.

More particularly, an apparatus of the present invention preferably includes a waste material grinder positioned to grind the relatively large particle waste material into relatively much smaller particles, a ground waste core material feeder positioned downstream from the waste material grinder to feed ground waste core material downstream, a core pad former positioned downstream from the ground waste core material feeder to form the core material into a plurality of individual core pads, a core pad encaser positioned downstream from the core pad former to encase the plurality of individual core pads with a selected sheet of material to thereby form a sheet of a plurality of shock and moisture absorbing pads, and a pad separator positioned downstream the pad sheet conveyor to separate the sheet into a plurality of individual shock and moisture absorbing pads.

A shock and moisture absorbing pad is also provided according to the present invention. The pad preferably includes a core pad formed from a particulate material, an elongate lower sheet underlying the core pad, an elongate upper sheet overlying the core pad, and an adhesive material contacting each of the upper and lower sheets. The particulate material of the pad preferably includes at least one of the following: super absorbency material, fluff, elastic, polymeric material, and glue. Also, the upper and lower sheets of the pad preferably include paper.

A method of forming a plurality of shock and moisture absorbing pads is additionally provided according to the present invention. The method preferably includes grinding relatively large particle waste material into relatively much smaller waste material, forming the ground waste material into a plurality of individual core pads, encasing the plurality of individual core pads with a selected sheet of material to thereby form a sheet of a plurality of shock and moisture absorbing pads, and separating the sheet into a plurality of individual shock and moisture absorbing pads.

A method of using a shock and moisture absorbing pad is further provided and preferably includes positioning a shock and moisture absorbing pad in a container, positioning at least one product on the shock and moisture absorbing pad so that the at least one product abuttingly contacts the shock and moisture absorbing pad, and absorbing moisture from the at least one product by the shock and moisture absorbing pad.

BRIEF DESCRIPTION OF THE DRAWINGS

Some of the features, advantages, and benefits of the present invention having been stated, others will become apparent as the description proceeds when taken in conjunction with the accompanying drawings in which:

FIG. 4 is a perspective view of a stack of shock and moisture absorbing pads having produce positioned thereon and a container such as a box shown by broken lines according to the present invention; and FIG. 5 is an enlarged fragmentary view of a shock and moisture absorbing pad having a piece of produce positioned thereon according to the present invention.

DETAILED DESCRIPTION OF PREFERRED EMBODIMENTS

The present invention will now be described more fully hereinafter with reference to the accompanying drawings which illustrate preferred embodiments of the invention. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, the prime notation, if used, indicates similar elements in alternative embodiments.

Figure 1:
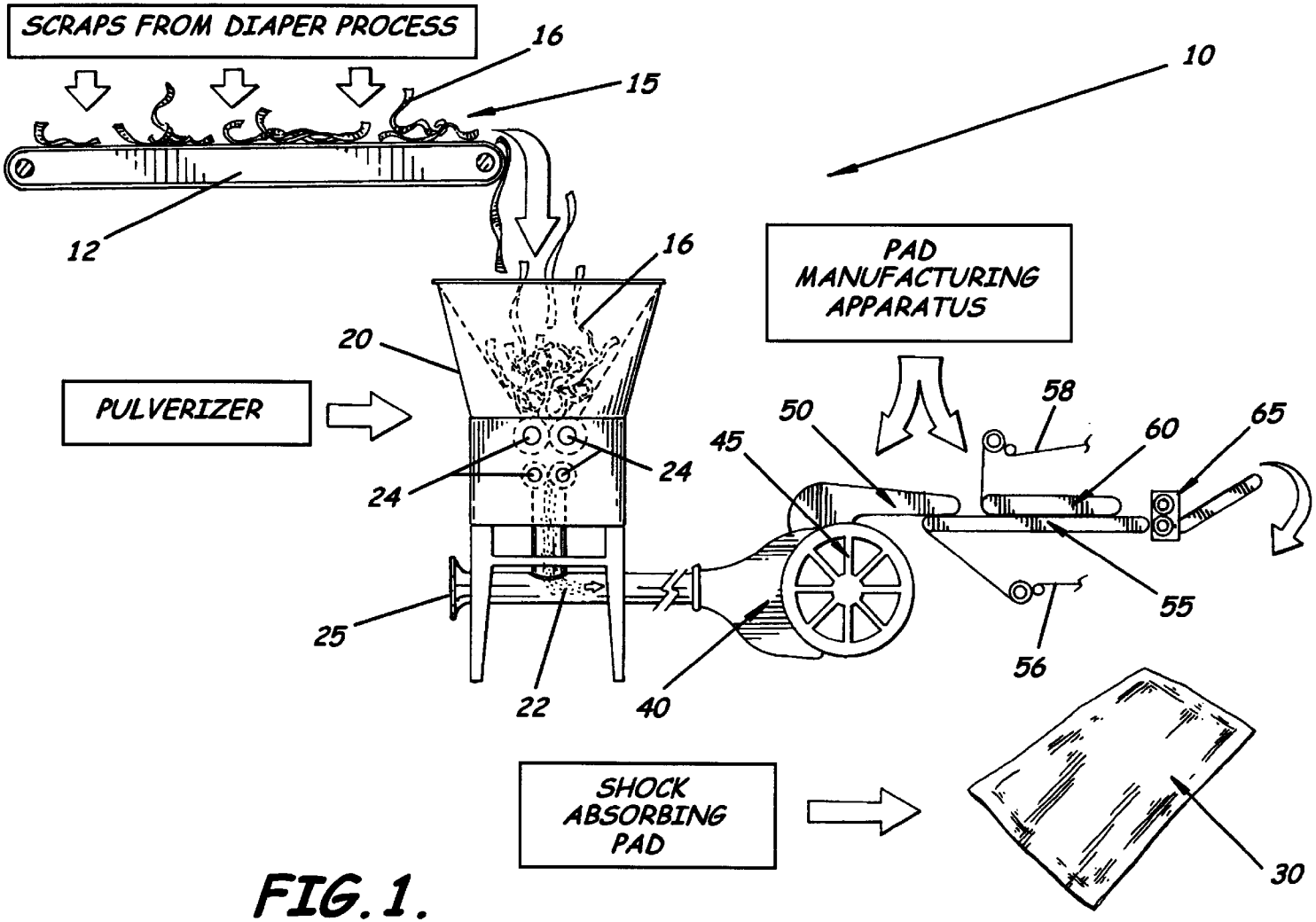
FIG. 1 is a schematic elevational view of an apparatus for producing shock and moisture absorbing pads according to the present invention.

FIG. 1 illustrates an apparatus 10 for producing shock and moisture absorbing pads 30 according to the present invention. The apparatus 10 of the present invention preferably includes a waste material supply 15 positioned to supply relatively large particles of waste material 16. The waste material supply 15 preferably advantageously allows large particle waste material 16 such as from a disposable diaper manufacturing process, or other product manufacturing process where waste material is generated, to be loaded or dumped from a bin or other container onto a waste feed conveyor 12 which can form a portion of the waste material supply 15 to convey the large particle or particulate waste material 16 downstream. The large particles or particulate material 16 from such a process preferably includes at least one of the following: super absorbency material, e.g., a super absorbency polymer ("SAP"), fluff, elastic, polymeric material, and glue. Such waste material can readily be found in many disposable undergarment manufacturing processes.

Figure 2:
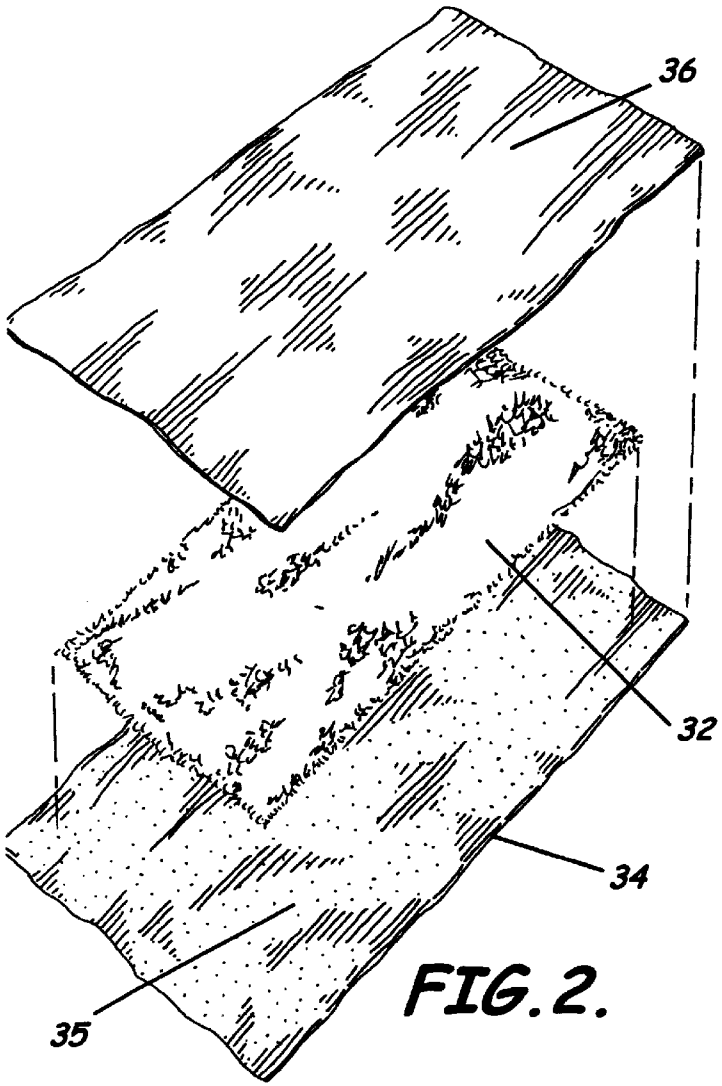
FIG. 2 is an exploded perspective view of a shock and moisture absorbing pad produced by an apparatus for producing shock and moisture absorbing pads according to the present invention.

A waste material pulverizer 20, e.g., a grinder, is preferably positioned downstream from the waste material supply 15 to pulverize or grind the large particle waste material 16 into relatively much smaller particles 22 (see also FIG. 2). As illustrated, the grinder 20, for example, can include a plurality of rollers 24 having a nip or grinding point therebetween which the large waste material passes through. The rollers preferably have teeth, roughened surfaces, or other grinding, chopping, cutting, smashing, or other pulverizing capabilities as understood by those skilled in the art which pulverize the large material 16 into the smaller particle material 22.

The apparatus 10 further preferably has a blower 25 positioned upstream from a ground waste core material feeder 40 and downstream from the pulverizer or grinder 20 to blowingly supply air, e.g., by a fan or other air or gas assist device, to the ground waste core material 22 to thereby blow the ground waste core material 22 to a core pad former 45 downstream. The ground waste core material feeder 40, which can include a conveyor, conveyor wheel, or other feeding device as understood by those skilled in the art, is preferably positioned downstream from the blower 25 to feed ground waste core material 22 downstream. The core pad former 45 is positioned downstream from the ground waste core material feeder 40 to form the core material 22 into a plurality of individual core pads 32. A core pad conveyor 50 is preferably positioned to receive each of the plurality of individual core pads 32 and conveying the same downstream, and a core pad encaser 55 is positioned downstream from the core pad former 45 for encasing the plurality of individual core pads 32 with a selected sheet of material to thereby form a sheet of a plurality of shock and moisture absorbing pads 30. The core pad encaser 55, as illustrated, preferably includes a bottom sheet delivery 56 positioned to deliver a sheet of material which forms a bottom sheet 34 underlying the plurality of individual core pads 32 and a top sheet delivery 58 positioned to deliver a sheet of material which forms a top sheet 36 overlying each of the plurality of individual core pads 32 and abuttingly contacting at least portions of the bottom sheet 34. The encasing material which forms the bottom and top sheets 34, 36 preferably is or includes paper which is relatively inexpensive, especially when purchased in rolls for feeding in such a delivery system.

The apparatus 10 also preferably includes a pad sheet debulking conveyor 60 positioned downstream from the core pad conveyor 50 and adjacent the core pad encaser 55 for debulking the sheet of the plurality of shock and moisture absorbing pads 30 and conveying the sheet of the plurality of shock and moisture absorbing pads 30 downstream. A pad separator 65, e.g., a knife or knife roll, is preferably positioned downstream from the pad sheet debulking conveyor 60 for separating the sheet into a plurality of individual shock and moisture absorbing pads 30. Other aspects of the apparatus 10 can be seen in additional detail and preferably include other portions from co-pending U.S. patent application Ser. No. 09/201,950, filed Dec. 1, 1998 and which is hereby incorporated herein by reference in its entirety. For brevity, many of these additional details are not repeated herein.

As perhaps best shown in FIGS. 1 and 2, a shock and moisture absorbing pad 30 is also provided according to the present invention. The pad 30 preferably includes a core pad 32 formed from a particulate material 22, an elongate lower or bottom sheet 34 underlying the core pad 32, an elongate upper or top sheet 36 overlying the core pad 32, and an adhesive material 35 contacting each of the lower and upper sheets 34, 36. The large particles or particulate material 16, such as from a manufacturing process, e.g., disposable undergarment manufacturing, preferably includes at least one of the following: super absorbency material, e.g., a super absorbency polymer ("SAP"), fluff, elastic, polymeric material, and glue. Also, the lower and upper sheets 34, 36 of the pad 30 preferably include paper. Each of the core pads 30 preferably has a substantially rectangular shape, and can further be advantageously shaped or formed to adapt to the inner shape of a container such as the boxes illustrated (see FIGS. 3–4).

As shown in FIGS. 1–5, a method of forming a plurality of shock and moisture absorbing pads 30 is additionally provided according to the present invention. The method preferably includes grinding relatively large particle waste material 16 into relatively much smaller waste material 22, forming the ground waste material 16 into a plurality of individual core pads 32, encasing the plurality of individual core pads 32 with a selected sheet of material to thereby form a sheet of a plurality of shock and moisture absorbing pads 30, and separating the sheet into a plurality of individual shock and moisture absorbing pads 30 (see FIG. 1).

Figure 3:
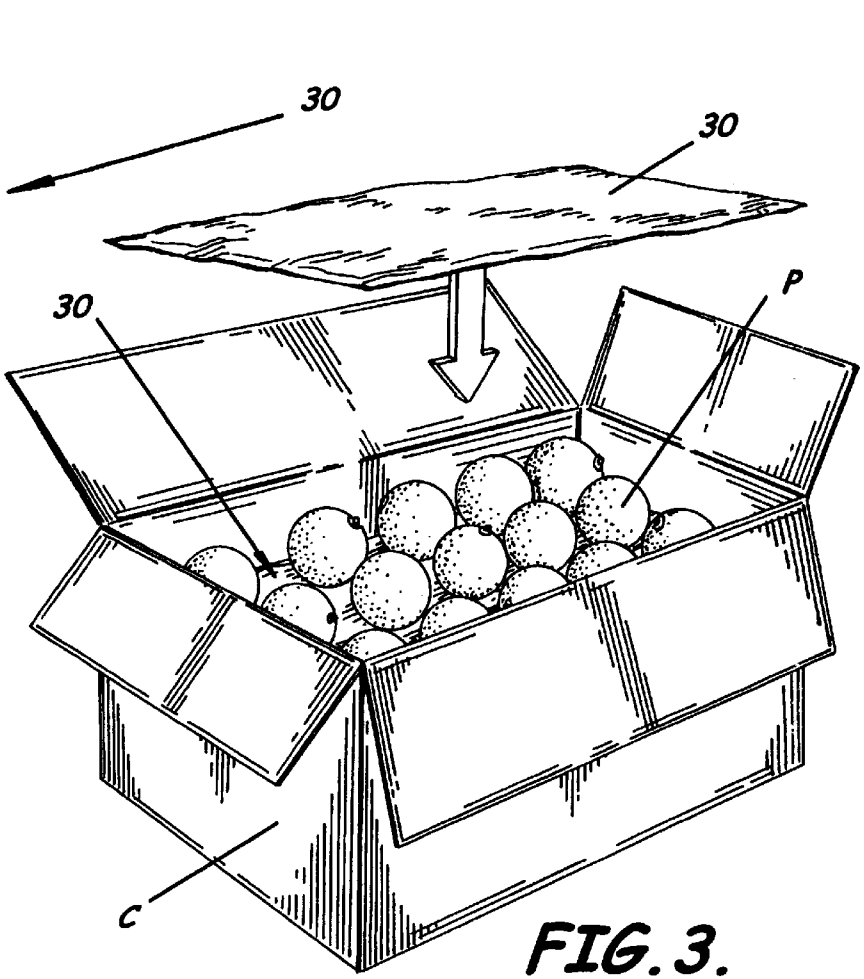
FIG. 3 is a perspective environmental view of shock and moisture absorbing pads currently positioned in and in the process of being positioned in a container having produce therein according to the present invention.

As shown in FIGS. 3–5, a method of using a shock and moisture absorbing pad 30 is further provided. This method preferably includes positioning a shock and moisture absorbing pad 30 in a container C, positioning at least one product P on the shock and moisture absorbing pad 30 so that the at least one product P abuttingly contacts the shock and moisture absorbing pad 30, and absorbing moisture from the at least one product P by the shock and moisture absorbing pad 30 (see FIGS. 4–5).

The method can also include the shock and moisture absorbing pad 30 being a first shock and moisture absorbing pad, and the method further includes the step of positioning a second shock and moisture absorbing pad to thereby overlie the at least one product (see FIGS. 3–4). The at least one product P is preferably a plurality of pieces of produce, such as oranges, grapefruits, pears, apples, or other fruits or vegetables as understood by those skilled in the art. Moisture from the produce can advantageously be absorbed by the pads 30 which enhances the handling and shipping process for manufacturers, distributors, and end customers. The first and second shock and moisture absorbing pads preferably each include a core pad 32 formed from a particulate material, an elongate lower sheet 34 underlying the core pad, an elongate upper sheet 36 overlying the core pad, and an adhesive material 35 contacting each of the lower and upper sheets 34, 36. The particulate material 22 of the core 32 preferably includes at least one of the following: super absorbency material, fluff, elastic, polymeric material, and glue, and the lower and upper sheets 34, 36 preferably include paper. Also, the positioning of the lower and upper sheets 34, 36, within a pad 30 is relative as shown and understood by those skilled in the art.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

That which is claimed:

1. An apparatus for producing a plurality of shock and moisture absorbing pads, the apparatus comprising:

a waste material supply positioned to supply relatively large particles of waste material;

a waste material grinder positioned downstream from said waste material supply to grind the waste material into relatively much smaller particles;

a ground waste core material feeder positioned downstream from said waste material grinder to feed ground waste core material downstream;

a core pad former positioned downstream from said ground waste core material feeder to form the core material into a plurality of individual core pads;

a core pad conveyor positioned to receive each of the plurality of individual core pads and conveying the same downstream;

a core pad encaser positioned downstream from said core pad former for encasing the plurality of individual core pads with a selected sheet of material to thereby form a sheet of a plurality of shock and moisture absorbing pads;

a pad sheet debulking conveyor positioned downstream from said core pad conveyor and adjacent said core pad encaser for debulking the sheet of the plurality of shock and moisture absorbing pads and conveying the sheet of the plurality of shock and moisture absorbing pads downstream; and a pad separator positioned downstream from said pad sheet conveyor for separating the sheet into a plurality of individual shock and moisture absorbing pads.

2. An apparatus as defined in claim 1, wherein the large particle waste material include waste material from a disposable undergarment manufacturing process.

3. An apparatus as defined in claim 1, further comprising a blower positioned upstream from said ground waste core material feeder to blowingly supply air to the ground waste core material to thereby blow the ground waste core material to said core pad former.

4. An apparatus as defined in claim 1, wherein said core pad encaser includes a bottom sheet delivery positioned to deliver a sheet of material which forms a bottom sheet underlying the plurality of individual core pads and a top sheet delivery positioned to deliver a sheet of material which forms a top sheet overlying each of the plurality of individual core pads and abuttingly contacting at least portions of the bottom sheet.

5. An apparatus as defined in claim 4, wherein the encasing material includes paper.

6. An apparatus for producing a plurality of shock and moisture absorbing pads, the apparatus comprising:

a waste material grinder positioned to grind the relatively large particle waste material into relatively much smaller particles;

a ground waste core material feeder positioned downstream from said waste material grinder to feed ground waste core material downstream;

a core pad former positioned downstream from said ground waste core material feeder to form the core material into a plurality of individual core pads;

a core pad encaser positioned downstream from said core pad former to encase the plurality of individual core pads with a selected sheet of material to thereby form a sheet of a plurality of shock and moisture absorbing pads; and a pad separator positioned downstream from said pad sheet conveyor to separate the sheet into a plurality of individual shock and moisture absorbing pads.

7. An apparatus as defined in claim 6, wherein the large particle waste material include waste material from a disposable undergarment manufacturing process which includes at least one of the following: super absorbency material, fluff, elastic, polymeric material, and glue.

8. An apparatus as defined in claim 7, further comprising a blower positioned upstream from said ground waste core material feeder to blowingly supply air to the ground waste core material to thereby blow the ground waste core material to said core pad former.

9. An apparatus as defined in claim 6, wherein said core pad encaser includes a bottom sheet delivery positioned to deliver a sheet of material which forms a bottom sheet underlying the plurality of individual core pads and a top sheet delivery positioned to deliver a sheet of material which forms a top sheet overlying each of the plurality of individual core pads and abuttingly contacting at least portions of the bottom sheet.

10. An apparatus as defined in claim 9, wherein the encasing material includes paper.

11. A method of forming a plurality of shock and moisture absorbing pads, the method comprising the steps of:

grinding relatively large particle waste material into relatively much smaller waste material;

forming the ground waste material into a plurality of individual core pads;

encasing the plurality of individual core pads with a selected sheet of material to thereby form a sheet of a plurality of shock and moisture absorbing pads; and separating the sheet into a plurality of individual shock and moisture absorbing pads.

12. A method as defined in claim 11, wherein the relatively large particle waste material is waste material from a disposable undergarment manufacturing process and includes at least one of the following: super absorbency material, fluff, elastic, polymeric material, and glue.

* * * * *